US007065909B2

(12) United States Patent
Snyder

(10) Patent No.: US 7,065,909 B2
(45) Date of Patent: Jun. 27, 2006

(54) PORTABLE ANIMATED ILLUMINATED PANEL DISPLAY DEVICE

(75) Inventor: Scott Snyder, Los Angeles, CA (US)

(73) Assignee: Highly Graphic, Inc., Los Angeles, CA (US)

( * ) Notice: Subject to any disclaimer, the term of this patent is extended or adjusted under 35 U.S.C. 154(b) by 0 days.

(21) Appl. No.: 10/702,936

(22) Filed: Nov. 5, 2003

(65) Prior Publication Data

US 2005/0091890 A1 May 5, 2005

(51) Int. Cl.
*G09F 13/22* (2006.01)

(52) U.S. Cl. ..... 40/544; 40/542

(58) Field of Classification Search ..... 40/544, 40/542, 734

See application file for complete search history.

(56) References Cited

U.S. PATENT DOCUMENTS

| | | | | |
|---|---|---|---|---|
| 3,573,532 | A | 4/1971 | Boucher | |
| 4,195,431 | A | 4/1980 | Neufeld | |
| 4,494,326 | A | 1/1985 | Kanamori | |
| 4,645,970 | A | 2/1987 | Murphy | |
| 5,005,306 | A | 4/1991 | Kinstler | |
| 5,408,774 | A * | 4/1995 | Grewe et al. | 40/606.15 |
| 5,516,387 | A | 5/1996 | Hoffman | |
| 5,566,384 | A | 10/1996 | Chien | |
| 5,845,987 | A | 12/1998 | Painter | |
| 6,056,425 | A | 5/2000 | Appelberg | |
| 6,112,437 | A | 9/2000 | Lovitt | |
| 6,205,690 | B1 * | 3/2001 | Heropoulos et al. | 40/442 |
| 6,224,224 | B1 | 5/2001 | Bear | |
| 6,430,854 | B1 * | 8/2002 | Szentgyorgyi et al. | 40/593 |
| 6,640,474 | B1 * | 11/2003 | Knoerzer et al. | 40/455 |

* cited by examiner

*Primary Examiner*—Cassandra Davis
(74) *Attorney, Agent, or Firm*—Caesar, Rivise, Bernstein, Cohen & Pokotilow, Ltd.

(57) ABSTRACT

A portable illuminated display device arranged to be mounted on various items, such as windows of vehicles or businesses or on garments. The device includes an illuminatable display panel, e.g., an electroluminescent, OLED, LCD or LED panel, and an associated driver/control unit. The display panel is made up of various illuminatable areas or segments arranged to be illuminated in a predetermined pattern and sequence by the driver/control unit to produce an animated display of graphic and/or text.

2 Claims, 5 Drawing Sheets

PORTABLE ANIMATED ILLUMINATED PANEL DISPLAY DEVICE

BACKGROUND OF THE INVENTION

1. Field of Invention

This invention relates generally to animated displays, and more particularly to animated displays using illuminatable, e.g., electroluminescent, OLED, etc., panels that are arranged to be mounted on various support structures, e.g., windows of automobiles or businesses, and whose panels are replaceable to change the animated display.

2. Description of Related Art

The prior art includes various patents disclosing electroluminescent panels for use in or on vehicles to provide a visual display of graphics and/or text. For example, U.S. Pat. No. 4,494,326 (Kanamori) discloses a window mounted marker light for displaying a corporate logo or the type, model etc. of the vehicle.

U.S. Pat. No. 4,465,970 (Murphy) also discloses a window mounted marker light for displaying a corporate logo or the type, model etc. of the vehicle.

U.S. Pat. No. 5,005,306 (Kinstler) discloses a flexible electroluminescent sign arranged to be removably attached to a vehicle, e.g., on the vehicle's door, and powered by the vehicles electrical system.

U.S. Pat. No. 5,516,387 (Hoffman) discloses an illuminated sign for adhesive bonding to the inside surface of an automobile window. The sign is made up of an electroluminescent panel and a removable indicia bearing member e.g., a stencil, disposed over the electroluminescent panel so that when the electroluminescent is illuminated light passes through the stencil to produce a display visible from outside the vehicle.

U.S. Pat. No. 5,566,384 (Chien) discloses illuminated signs located in the window of a vehicle and on its bumper. The signs are made up of electroluminescent panels and associated power packs, where can be attached to the vehicle a by adhesion or other appropriate devices.

U.S. Pat. No. 6,056,425 (Apelberg) discloses illuminated roof mounted sign assembly for a motor vehicle, e.g., a taxi. The assembly includes a flexible electroluminescent panels over which a transparent panel bearing indicia, e.g., the word "TAXI" is disposed for illuminating that indicia.

The use of electroluminescent devices to produce animated displays is shown in various United States patents. For example, U.S. Pat. No. 6,205,690 discloses a panel, page or substrate having a tier of electroluminescent material to form a pattern corresponding to a series of images. When illuminated in accordance with a predetermined sequence, the series of images provides the illusion of movement or animation.

U.S. Pat. No. 6,224,224 (Bear) discloses a cold light signboard having distributed luminous regions arranged to be illuminated in a predetermined sequence from a control circuit. Power is provided by either a battery box or a general power supply.

Other products or devices making use of electroluminescent displays are found in U.S. Pat. No. 3,573,532 (Boucher), U.S. Pat No. 4,195,431 (Neufeld), U.S. Pat No. 5,845,987 (Painter), and U.S. Pat No. 6,112,437 (Lovitt).

While all of the foregoing devices may be suitable for their general purposes they still leave much to be desired from various standpoints, such as ease of use, ease of changing the display and/or its pattern/sequence patterns, suitability for use with various power sources, ease of mounting on various types of support items, etc. Thus, a need exists for a device which addresses those needs.

All references cited herein are incorporated herein by reference in their entireties.

BRIEF SUMMARY OF THE INVENTION

A portable animated illuminated, e.g., electroluminescent, display device comprising a housing, a first illuminatable, e.g., electroluminescent, panel assembly, a electrical control circuit, an electrical power source, e.g., a battery or a circuit to convert 12 VDC power from an automobile or 110 VAC line current to a voltage appropriate for use by the illuminatable, e.g., electroluminescent, panel, and releasably securable mounting means, e.g., one or more suction cups.

The first illuminatable, e.g., electroluminescent, panel assembly comprises a thin integral unit having a front surface and a peripheral edge. The front surface of the unit defines plural graphic areas. The first unit is arranged to be releasably mounted within a portion of the housing so that the front surface of the first unit is visible while the peripheral edge of the unit is covered. The first unit has plural electrical conductors extending therefrom arranged to be releasably coupled to the power source and to the electrical control circuit.

Each of the graphic areas of the first unit is arranged to be illuminated internally upon the application of electrical energy thereto from the power source, e.g., battery, under the control of the electrical control circuit to produce an animated display, e.g., flashing colored graphics.

The releasably securable mounting means, e.g., suction cups, are arranged to secure the device onto a support object, e.g., the window of a vehicle, a store, etc., so that the graphic areas are visible to viewers.

The first illuminatable, e.g., electroluminescent, panel unit is removable from the housing to be replaced by a second and different illuminatable, e.g., electroluminescent, panel unit having plural graphic areas arranged to be illuminated upon the application of electrical energy thereto, so that the device provide a different animated display.

BRIEF DESCRIPTION OF SEVERAL VIEWS OF THE DRAWINGS

The invention will be described in conjunction with the following drawings in which like reference numerals designate like elements and wherein.

DETAILED DESCRIPTION OF THE INVENTION

Figure 1:
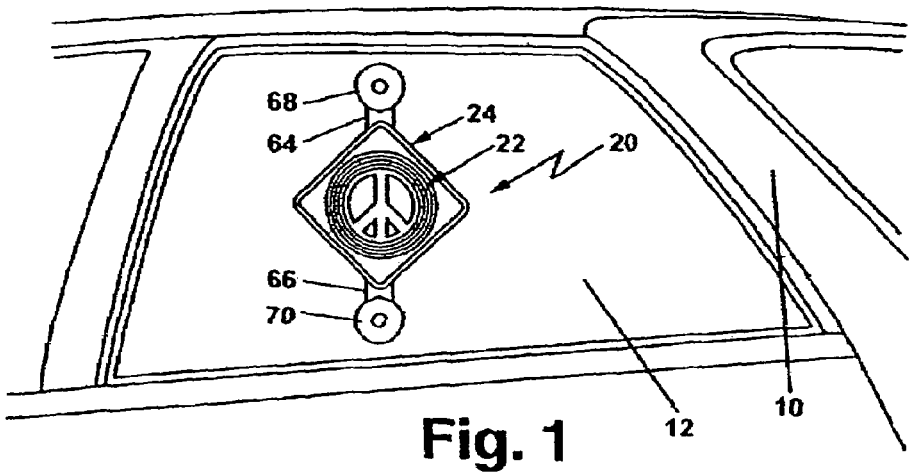
FIG. 1 is a elevation view of one embodiment of a portable animated illuminated, e.g., electroluminescent, display device constructed in accordance with this invention shown releasably mounted in the window of a conventional vehicle.

Referring now to the various figures of the drawing wherein like reference characters refer to like parts, there is shown generally at 20 an animated display device. That device makes use of an illuminatable, e.g., electroluminescent or OLED, panel 22 (to be described later) that includes various segments or areas arranged to be illuminated in one or more desired sequences or patterns. The panel is releasably mounted in a housing 24 that is itself arranged to be releasably mounted on various support structures, e.g., a window 12 of a vehicle 10, a front window of a retail business (not shown), etc., so that the animated display provided by the panel 22 can be seen by persons in the vicinity. Moreover, as will also be described later the illuminatable panel 22 of the device 20 is preferably replaceable to change from one animated display to another, when desired.

Figure 4:
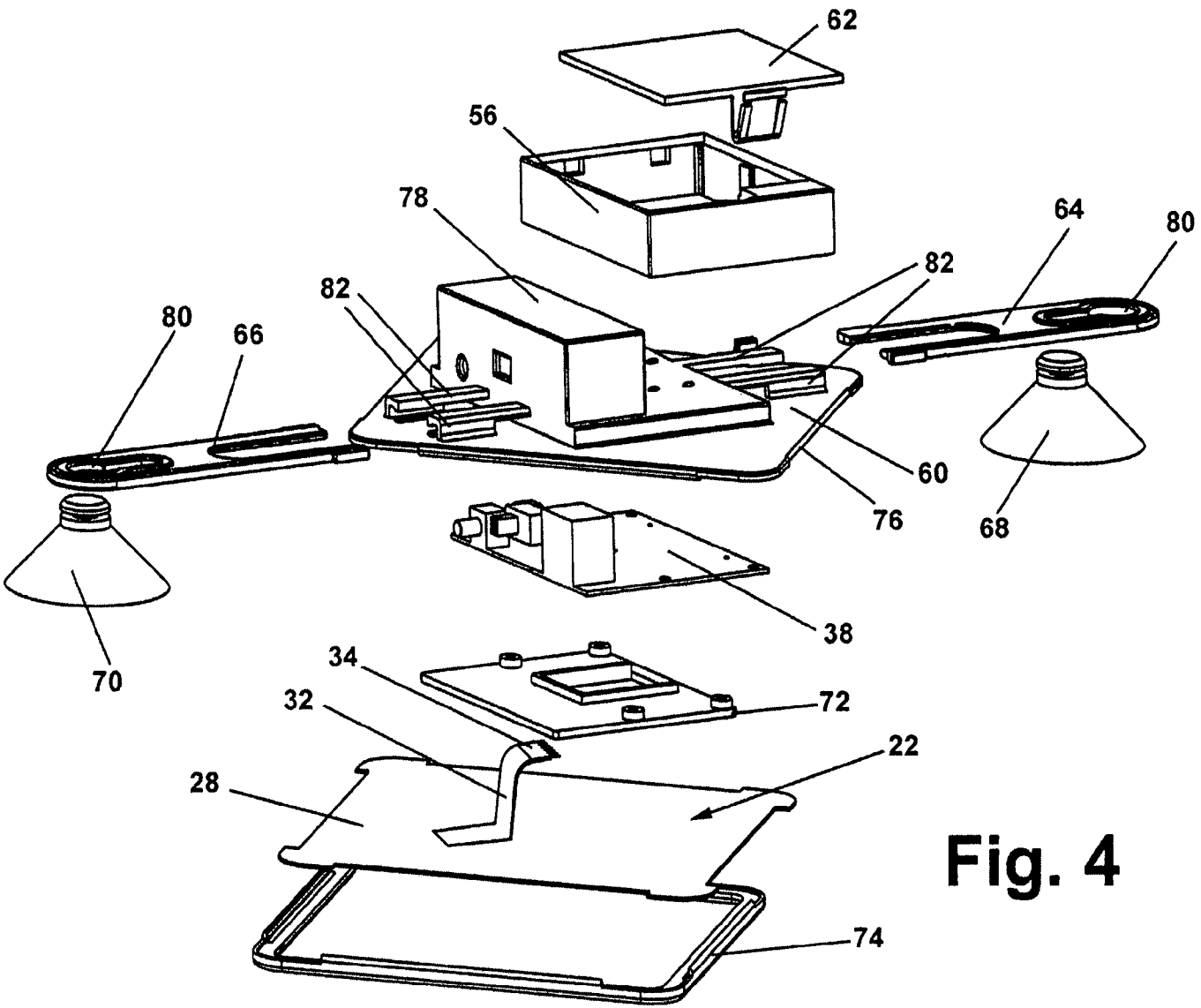
FIG. 4 is an exploded isometric view of the portable animated illuminated display device shown in FIGS. 1 and 2.

The illuminatable panel 22 is a conventional EL plate that is commercially available from various vendors. The plate is a thin planar member having a front surface 26 and a rear surface 28 (FIG. 4). The shape of the panel 22 is a matter of choice. In the embodiment shown it is diamond-like. This shape is merely exemplary of any shape that the panel can take.

As is conventional the panel 22 includes various illuminatable areas or segments that are visible from the front surface of the panel. In the exemplary embodiment shown in FIGS. 1 and 2, there are five such areas or segments 30A, 30B, 30C, 30D, and 30E, which collectively define a desired graphic or image on the front face of the panel. In this case those segments make up the well-known "peace" symbol having two concentric rings extending about it. The segments 30A–30E are arranged to be illuminated in one of twelve possible sequences by a control circuit, to be described later. If desired, the panel may be constructed so that each segment when illuminated produces a different color. Any desired image or graphics, including text, can be implemented by the panel 22, so that the "peace" symbol graphics shown herein is merely exemplary of a myriad of visual displays that can be incorporated in a device of this invention.

The EL plate or panel 22 includes two common electrical input pins (not shown) and plural electrical segment pins (not shown), one segment pin is associated with each area or segment of the EL panel. The electrical signals and power to effect the illumination of the panel 22 are provided via a flat-ribbon cable 32 (FIG. 4). As best seen in FIG. 4 one end of the cable 32 is fixedly secured to the rear of the panel 22 so that its appropriate conductors are connected to the pins of the EL panel. The other end of the ribbon cable 32 is in the form of a pronged or male connector 34. The connector 34 is adapted to be releasably coupled to a mating, female connector (not shown)on a printed circuit board 38 of the device 20. The printed circuit board 38 forms the driver/controller for the device 20, i.e., it produces the electrical signals for effecting the illumination of the EL panel 22 and includes the various electrical components of the device mounted thereon. The printed circuit board 38 is mounted within the housing 24.

Figure 3:
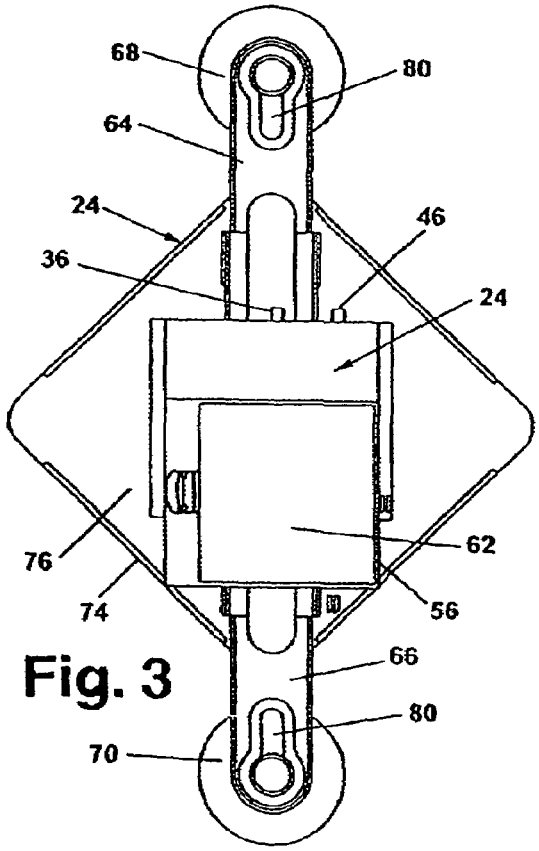
FIG. 3 is a rear elevation view of the portable animated illuminated display device shown in FIG. 2.
Figure 5:
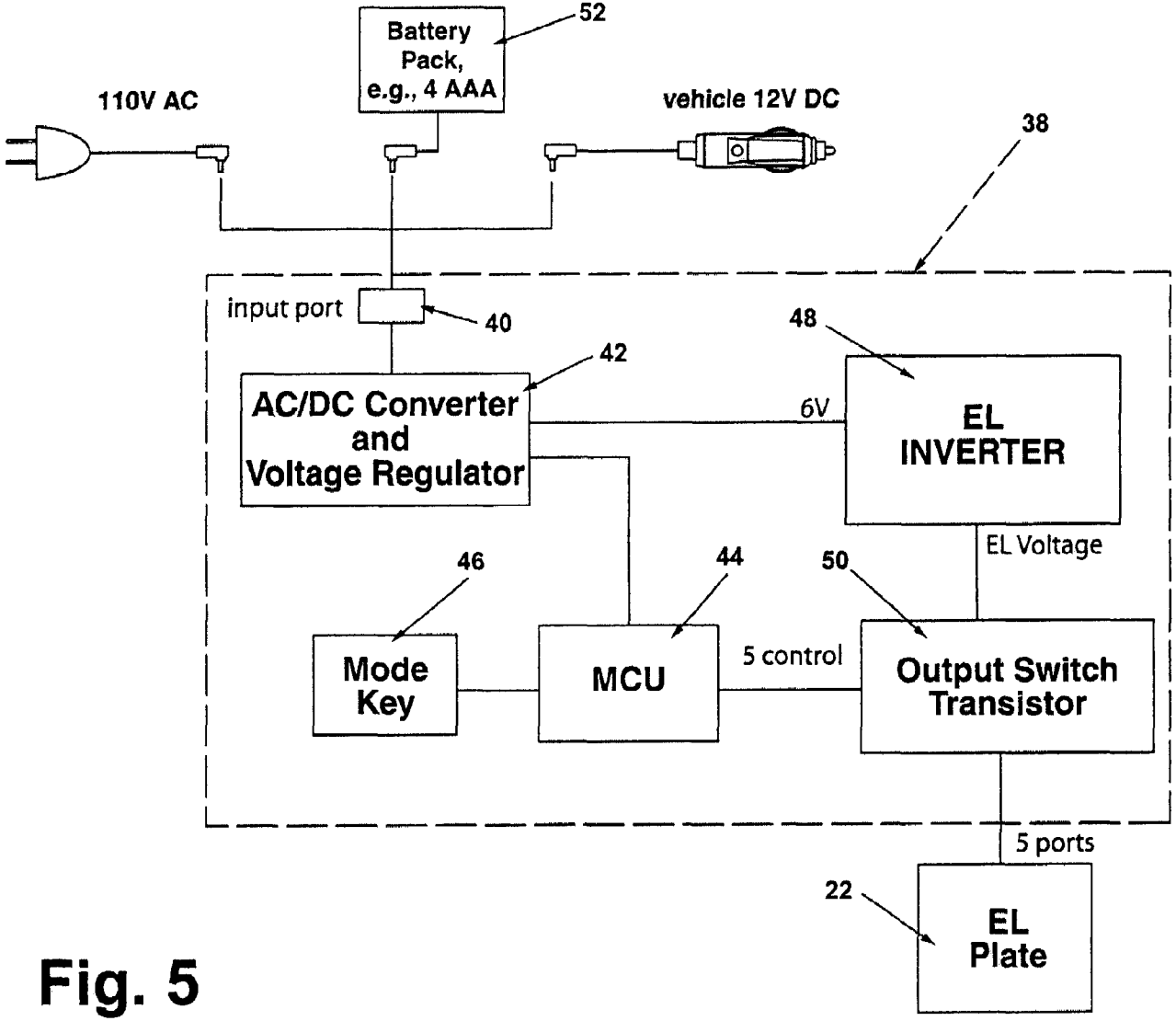
FIG. 5 is a block diagram of the electrical components making up the portable animated illuminated display device shown in FIGS. 1 and 2.

The details of the electrical components of the driver/controller will now be described by reference to the block diagram of FIG. 5. Thus, as can be seen the driver/controller basically comprises an Input Port 40, an AC/DC Converter and Voltage Regulator 42, a Microcontroller unit (MCU) 44, a Mode Key 46, an EL Inverter 48, Output Switch Transistor(s) 50 and the heretofore identified EL Plate or panel 22. An ON/OFF power switch 36 (FIG. 3) is mounted in the housing to turn the device's power on or off.

The device 20 is arranged to be powered from various power sources, such an external 110V conventional AC line voltage found in most homes and businesses, an external 12V DC voltage (such as found in most vehicles), as well as an internal 6 V DC battery pack. To achieve that end as best seen in FIG. 5 the Input Port 40 is adapted to be connected to either a 110 VAC line, a 12V DC line or a 6 VDC line from a battery pack 52, e.g., 4 AAA batteries (not shown). Those batteries are mounted within a compartment 56 (FIG. 4) forming a portion of the housing 24. The 6 VDC line from the battery pack 52 is preferably always connected to the input port 40 so that battery power is always available, but is automatically disabled if any other input, e.g., the externally applied 110 VAC or 12 VDC, is provided. The Input Port 40 is connected to the AC/DC Converter and Voltage Regulator 42. While not shown in the drawing the AC/DC Converter and Voltage Regulator 42 is coupled to the ON/OFF switch 36. When the ON/OFF switch 36 is in its ON position the AC/DC Converter and Voltage Regulator 42 converts a 110 VAC current input into direct current and regulates it to a desired stable output voltage for the rest of the circuitry, e.g., 6 Volts. The circuit 42 also regulates the 12 VDC vehicle power input to the desired stabilized output voltage when the ON/OFF switch is in the ON position and the 12 VDC supply is connected to the input port 40. If no external input voltage is connected to the input port, the 6 VDC power from the battery pack 52 will be provided to the AC/DC Converter and Voltage Regulator 42 when the ON/OFF switch is moved to the on position. The circuit 42 also stabilizes that input voltage. Moreover, the circuit 42 also provides the automatic switching path for the battery and the external voltage.

The 6VDC output of the AC/DC Converter and Voltage Regulator 42 is provided as an input to the EL Inverter 48. The EL Inverter 48 converts the low DC voltage, e.g., 6 volts, to a high AC voltage (the "EL voltage") that is sufficient to effect the illumination of the EL plate 22. As mentioned above, the EL plate or panel 22 is the lighting element of the device 20 and includes the illuminatable areas or segments 30A–30E. When the EL voltage is applied across one common pin and one segment pin of the EL plate 22, the corresponding display 30A–30E segment will be illuminated. In a preferred exemplary embodiment of this invention there are two common pins on the EL cable connector, these two pins are electrically equivalent and are located at the ends of the connector to protect the EL plate from a short circuit if the EL plate is connected in reverse.

In order to control the illumination of the areas or segments of the EL plate, the EL voltage is applied to the EL plate via the Switch Transistor(s) 50. Since the device 20 makes use of an EL plate 22 having five illuminatable areas or segments, five Switch Transistors are provided, one for each illuminatable area 30A–30E. The electrical signals to illuminate the areas 30A–30E are provided via five ports from the five Output Switch Transistor(s) 50. Each Output Switch Transistor 50 is arranged to be controlled individually, i.e., turned on and off, by the Microcontroller or MCU 52. The Microcontroller 44 is a conventional device that is arranged to provide control signals via five control lines to the five Output Switch Transistors to establish the particular flashing pattern or sequence of EL plate's segments 30A–30E.

In one preferred exemplary embodiment the MCU has a total of twelve different lighting patterns or sequences programmed in it. The twelve illumination patterns or sequences provided by the exemplary device are: 8 times roaming fast, 8 times roaming slow, stacking fast, stacking slow, sequential fast, sequential slow, roaming fast, roaming slow, queing fast, queing slow, random fast and random slow. The selection of any particular pattern or sequence is accomplished by the Mode Key 46. The Mode Key 46 basically comprises a button mounted on the housing 24 (see FIG. 3). The button 46 is arranged to be pressed by the user and is electrically connected to the MCU. The MCU is arranged to monitor the Mode Key (button) input on a continuous basis. Thus, when the button 46 is pressed, the MCU changes its state to provide appropriate output signals via the five control lines to the five Output Switch Transistors 50 to establish the desired flashing pattern or sequence of illumination of the respective areas 30A–30E of the EL panel 22.

It should be pointed out at this juncture that the number and sequence of illumination of various segments or areas of the illuminatable panel 22 is purely a matter of choice, so that the EL panel and its five port associated control circuit, is merely exemplary of various electronic circuits that can be used. Thus, for example, the device 20 can make use of a circuit board having more than five ports to effect the illumination of more than five segments or areas of the display panel.

Turning now to FIG. 4 the details of the housing 24 will now be described. As can be seen the housing 24 basically comprise a frame assembly 60, the heretofore identified battery compartment 56, a battery compartment cover or door 62, a pair of suction cup holder arms 64 and 66, a pair of suction cups 68 and 70, a cover 72 for the printed circuit board 38 and a releasably securable frame cover 74. The frame assembly 60 includes a generally planar plate portion 76 which is of the same diamond shape as the EL panel 22, but is slightly larger in size. The EL panel is adapted to be disposed on the plate portion 76 of the frame assembly 60, with the connector 34 at the end of the ribbon cable 32 connected to the mating connector on the printed circuit board 38. The frame assembly 60 also includes plural hollow portions 78 which upstand from the plate portion 76 to accommodate the various electrical/electronic components mounted on the printed circuit board 38. The printed circuit board cover 72 is disposed over the opposite side of the printed circuit board from the plate portion 76, so that the printed circuit board is sandwiched between the plate portion 76 and the printed circuit board cover 72. The printed circuit board cover 72 is mounted flush to the center of the surface of the plate portion 76. This arrangement creates a generally planar surface on which the EL panel 22 can be disposed.

The frame cover 74 is of the same diamond shape as the planar plate portion 76 of the frame assembly 60, but is slightly greater in size. The frame cover 74 is arranged to releasably snap fit onto the periphery of the plate portion 76 of the frame assembly 60 so that it overlies the peripheral edge of the EL panel 22, thereby protecting the edge of the EL panel from the ambient atmosphere. This is particularly useful for application wherein the device 20 will be subject to use in wet or moist conditions, which conditions could result in damage to the EL panel.

The battery compartment 56 is secured to the frame assembly 60 on the rear side of the plate portion 76 and is a hollow member sized to accommodate four conventional AAA batteries (not shown). The battery compartment door or cover 62 is arranged to be releasably secured to the battery compartment 56 to protect the batteries located therein.

Figure 2:
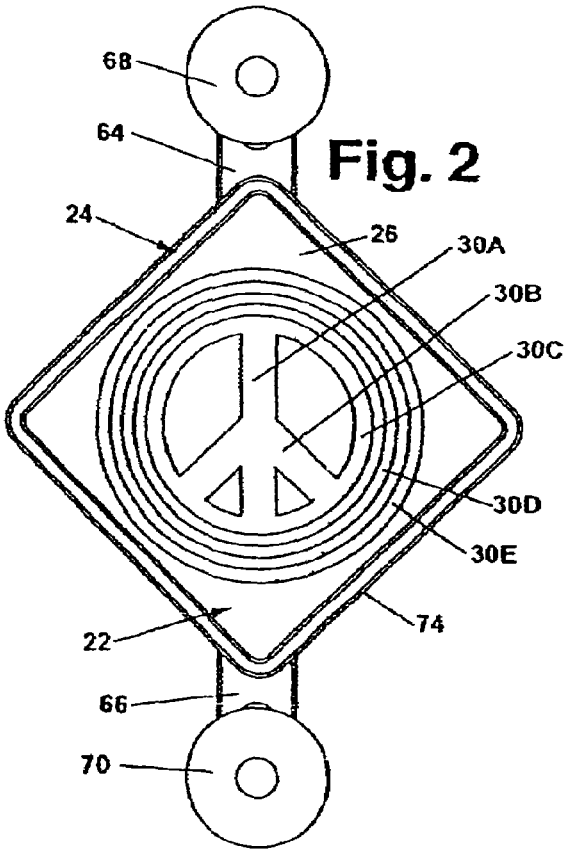
FIG. 2 is an enlarged front elevation view of the portable animated illuminated display device shown in FIG. 1.

The suction cup holder arms 64 and 66 are each elongated generally planar members having a free end in which a keyhole shaped opening or slot 80 is located. Each of the arms is arranged to be secured to the frame assembly via respective pairs of tracks 82 projecting outward from the rear surface of the planar plate portion 76 of the frame assembly, so that the arms 64 and 66 project diametrically away from each other. The suction cup 68 is arranged to be mounted within the keyhole slot 80 in the arm 64, while the other suction cup 70 is arranged to be mounted within the keyhole slot 80 in the arm 66. When so mounted the suction cups face outward in the same direction as the front face of the EL panel 22. Accordingly, the device 20 can be releasably secured to the inside surface of the window 10 of an automobile or other vehicle 12 as shown in FIG. 1, whereupon the EL panel is viewable by persons outside the vehicle.

The frame cover 74, by being releasably snap fit onto the periphery of the plate portion 76 of the frame assembly, is removable when desired to provide access to the EL plate 22. Thus, for example, if it is desired to change the EL plate 22 to provide a different animated display, all that is required is to remove the frame cover 74. This enables the EL plate to be lifted up to expose its connection to the printed circuit board 38, whereupon the two connectors can be disconnected. A different EL plate 22 bearing the desired visual display can then be connected to the printed circuit board by attaching the connector on the end of its cable to the printed circuit board connector, then placing the substituted EL plate on the front surface of the plate portion 76 of the frame unit and the flush-mounted printed circuit board cover. Once this is accomplished the frame cover 74 can be snap fit into place to secure the EL panel in place and to protect its peripheral edge.

Figure 8:
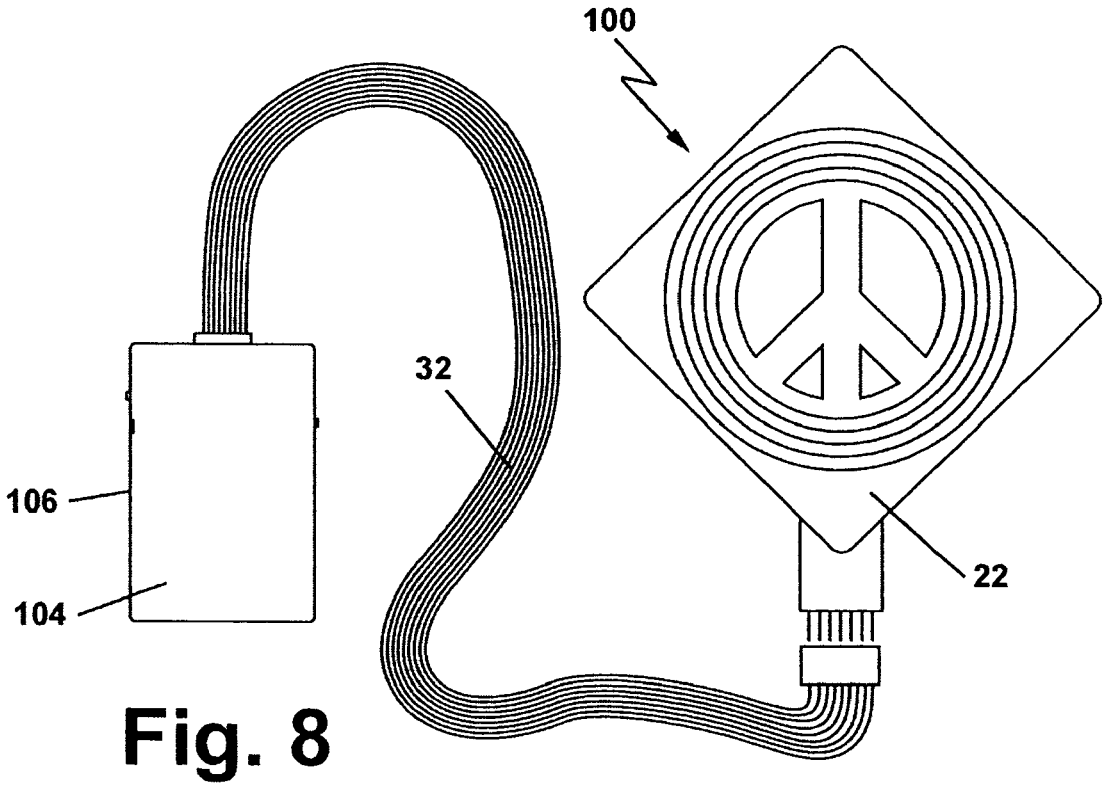
FIG. 8 is a front elevational view of a more preferred alternative embodiment of portable animated illuminated display device constructed in accordance with this invention adapted to be releasably mounted (worn) on a garment or clothing.

In FIG. 8 there is shown an alternative embodiment of a portable animated illuminatable device 100 of this invention. The device 100 is arranged to be mounted on any suitable article of clothing, e.g., a T-shirt 102 (FIG. 9), worn by a user. The wearable device 100 makes use of the EL panel 22 of the embodiment 20 described earlier, but using a self-contained EL driver/control unit 104. The EL driver control unit 104 basically comprises a housing 106 in which a circuit board (not shown), like that described with reference to device 20, is mounted. Power for the electrical components making up the driver/control unit 104 is in the form of four AAA batteries (not shown). The electrical components of the driver/control unit 104 are electrically connected to the EL panel 22 via a ribbon cable 32, like that described with reference to the device 20.

Figure 9:
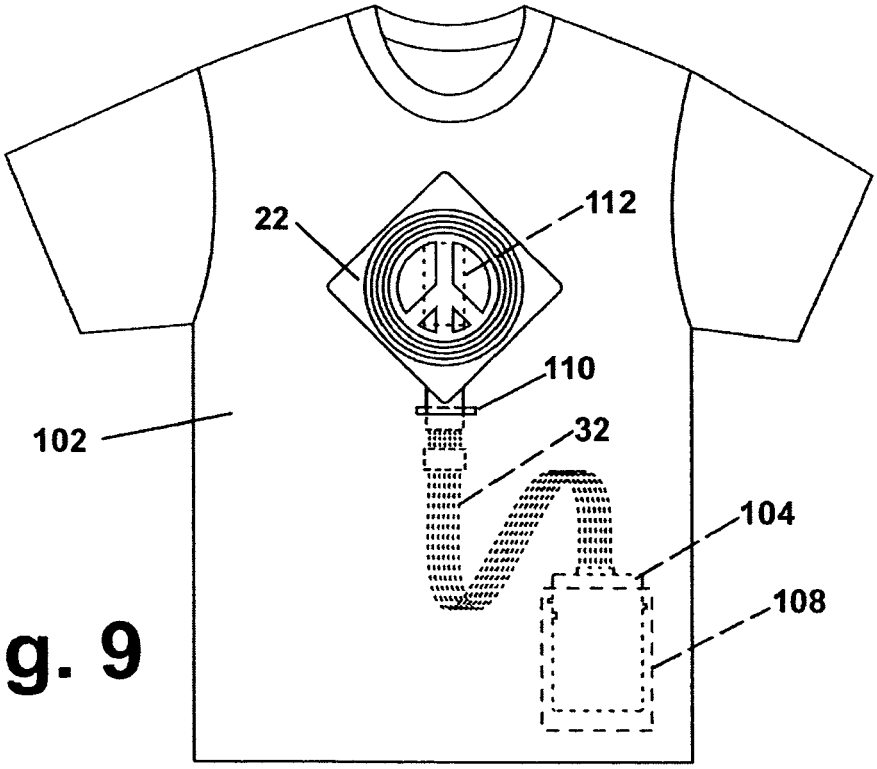
FIG. 9 is a reduced plan view showing the device of FIG. 8 in place mounted on a garment, e.g., a T-shirt.

Turning now to FIG. 9 the manner of usage of the device 100 will now be described. Four AAA batteries (not shown) are inserted into a battery compartment in the housing 106 of the EL driver/control unit 104, observing the proper +/– polarity. The EL driver/control unit 104 is then inserted into a pocket 108 attached to the inside of the T-shirt 102. The electronic ribbon cable 32 is threaded or placed along the inside the T-Shirt and then extended outside through the small hole or slit 110 in the T-shirt. A releasably securable mounting member 112 e.g., one patch component of a VELCRO® hook and loop fastening system, is fixedly secured on the T-shirt 102 near the hole 110. The patch 112 serves to releasably mount a cooperating patch component (not shown) of the VELCRO® hook and loop fastening system that is secured on the back surface of the EL panel 22. The connector at the free end of the ribbon cable 32 is then connected to the connector of the EL panel by inserting the metal prongs of the cable connector into the mating holes in the EL panel connector. The EL panel can then be releasably mounted on the front of the T-shirt by causing its VELCRO® patch to engage the VELCRO® patch 112 on the front of the T-shirt.

The device is now ready for use by merely pressing an ON/OFF power switch (not shown) on the EL driver/control unit 104 to the ON position. This causes the EL panel 22 to illuminate with the segments 30A–30E being illuminated in the sequence and pattern as selected by the user's actuation of the mode key button 46. That button is located on the side of the housing 106 of the EL driver/control unit 104. When illumination is no longer desired, the ON/OFF switch is depressed to turn the power off for the device and thereby conserve battery life.

It should be pointed out at this juncture that the portable device shown in FIG. 8 can be worn or mounted on other articles of clothing than the T-shirt shown in FIG. 9. Thus, any garment or article of clothing can be modified to accommodate a device constructed in accordance with this invention. In fact, the garment or article of clothing, need not be modified to accommodate a device of this invention, so long as it has a place for supporting the power/drive unit and a place for mounting the EL panel. With respect to the later the EL panel may include some mounting means, e.g., a pin or the like, on its rear surface that can be releasably secured to any garment or article of clothing.

Figure 7:
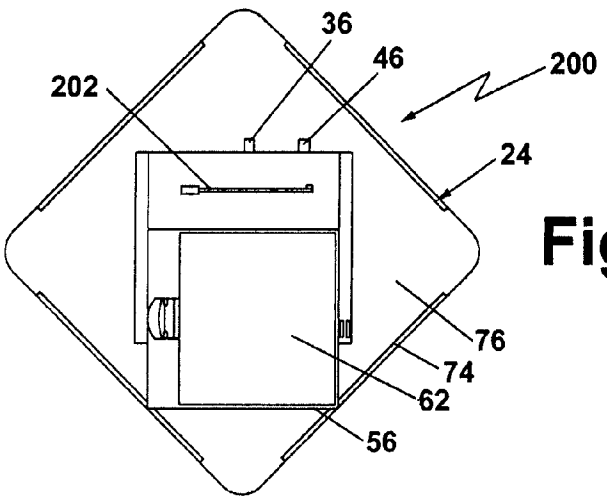
FIG. 7 is a rear view of an alternative embodiment of a portable animated illuminated display device constructed in accordance with this invention adapted to be releasably mounted (worn) on a garment or clothing.

In FIG. 7 there is shown a less preferred embodiment 200 of the invention for mounting on clothing. The device 200 basically comprises the same structure as the device 20, except that the housing 24 includes a conventional safety-type pin 202 mounted on the rear surface thereof. The use of the device 200 is as follows, the arms mounting the suction cups are removed from the device since they are not necessary for mounting the device on a garment. The pin 102 can then be opened to expose the piercing or pointed end and to extend it through the fabric of the garment or item onto which the device 200 is to be mounted. Then the pointed end of the pin can be moved back in place under the clasp portion of the pin to hold the pin in a closed state.

Figure 6:
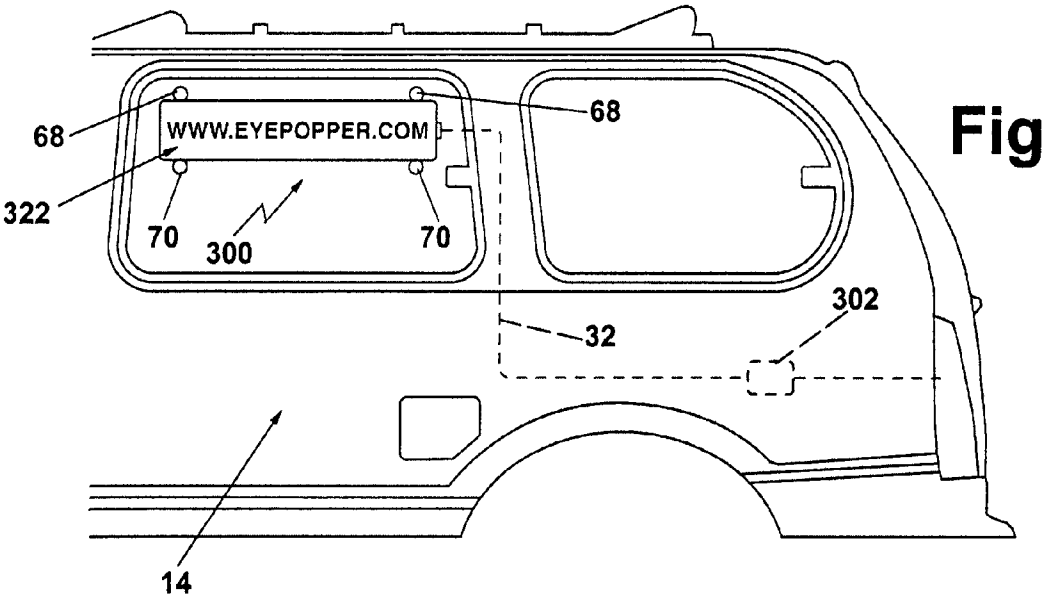
FIG. 6 is a elevation view of another embodiment of a portable animated illuminated, e.g., electroluminescent, display device constructed in accordance with this invention shown releasably mounted in the window of another conventional vehicle.

In FIG. 6 there is shown an alternative embodiment of a device 300 constructed in accordance with this invention. That device is basically the same general construction as the device 20, except for the shape of its EL panel and the animated image produced by it (e.g., it makes use of a rectangular shaped EL panel 322 which produces an animated display of an internet website) and the use of a permanently mounted driver/control unit 302 for the EL display panel. In particular, as can be seen driver/control unit 302 for the EL display is mounted within a vehicle 14, e.g., within a rear quarter panel of the vehicle, hidden from view. The electrical signals to illuminate and control the EL display panel 322 are provided from the unit 302 via a ribbon cable 32. The EL panel 322 is disposed within a housing similar to that of device 20, except for the shape of the housing and the use of two sets of suction cups 68 and 70 to mount the device 300 on the window 12.

It should also be pointed out that while all the devices described heretofore have included EL panels, other conventional illuminatable panel components can be used. For example, an OLED panel may be used in the device of this invention. One suitable OLED panel and associated driver component is sold by E.I. duPont de Nemours and Company under the trademark OLIGHT®. Other display panels that may be used in this invention are LED panels and LCD panels.

As will be appreciated by those skilled in the art from the foregoing, the devices of this invention can be mounted on the window of any vehicle, such as a car, truck, taxi or onto the window of a store or other business to provide a desired animated display. The display may be provided for functional, e.g., commercial, purposes or for aesthetic purposes or a combination of functional and aesthetic purposes. Thus, the display may consist of any type of graphics and/or text, depending upon the desired application. For purely aesthetic purposes, the devices of this invention can be arranged for mounting on a wall of a home, office or business to decorate it. Another field for which the subject devices have particular utility is safety applications. Examples of such applications are as a warning/danger sign, as a home security sign, or as a vehicular warning sign that the vehicle has broken down or is otherwise disabled, e.g, a person with a flat tire can attach the device to the window of the disabled vehicle or else to a garment worn by him/her to increase his/her visibility to oncoming traffic.

While the devices of this invention as described above are particularly suited for releasable mounting on windows, such as vehicle windows or windows of businesses by means of the heretofore described suction cups, such an arrangement is merely exemplary of various types of mounting means that can be used to mount a device of this invention to a window or any other panel-like support member. For example, the device of this invention may be releasably secured to the inside surface of a window by means of a static cling-like material (not shown)in lieu of the suction cups. In fact, it should be clear that the devices of this invention are not limited to mounting on a window or any other panel-like support member. Thus, they can be mounted on any item and used in any application wherein an animated display is desired.

In order to further enhance the value of the devices of this invention they may be provided with proximity detectors to control the operation of the devices. This arrangement may be particularly useful for security applications. Moreover, the devices may include sound generating means, e.g., an audio chip, to provide music and/or speech when the display is activated.

While the invention has been described in detail and with reference to specific examples thereof, it will be apparent to one skilled in the art that various changes and modifications can be made therein without departing from the spirit and scope thereof.

What is claimed is:

1. A portable animated illuminatable display device comprising a housing, a first illuminatable panel assembly, a electrical control circuit, an electrical power source and releasably securable mounting means, said first illuminatable panel assembly comprising a thin integral unit having a front surface and a peripheral edge, said front surface defining plural graphic areas, said first illuminatable panel assembly being arranged to be releasably mounted within a portion of said housing so that said front surface is visible and said peripheral edge is covered, said first illuminatable panel assembly having plural electrical conductors extending therefrom arranged to be releasably coupled to said power source and said electrical control circuit, each of said graphic areas being arranged to be illuminated internally upon the application of electrical energy to said first illuminatable panel assembly from said power source under the control of said electrical control circuit to produce an animated display, said releasably securable mounting means being arranged to releasably mount said device onto a support object so that said graphic areas are visible to viewers, said first illuminatable panel assembly being removable from said housing to be replaced by a second and different illuminatable panel assembly having plural graphic areas arranged to be illuminated upon the application of electrical energy thereto, whereupon the second illuminatable panel assembly can provide a different animated display, said housing comprising a releasably securable frame for protecting said peripheral edge of said first illuminatable panel assembly or the second illuminatable panel assembly when either illuminatable panel assembly is mounted within said portion of said housing.

2. A portable animated illuminatable display device comprising a housing, a first illuminatable panel assembly, a electrical control circuit, an electrical power source and releasably securable mounting means, said first illuminatable panel assembly comprising a thin integral unit having a front surface and a peripheral edge, said front surface defining plural graphic areas, said first illuminatable panel assembly being arranged to be releasably mounted within a portion of said housing so that said front surface is visible and said peripheral edge is covered, said first illuminatable panel assembly comprising an illuminatable panel selected from the group consisting of an electroluminescent (EL) panel, an OLED panel, a LCD panel and a LED panel, said first illuminatable panel assembly having plural electrical conductors extending therefrom arranged to be releasably coupled to said power source and said electrical control circuit, each of said graphic areas being arranged to be illuminated internally upon the application of electrical energy to said first illuminatable panel assembly from said power source under the control of said electrical control circuit to produce an animated display, said releasably securable mounting means being arranged to releasably mount said device onto a support object so that said graphic areas are visible to viewers, said first illuminatable panel assembly being removable from said housing to be replaced by a second and different illuminatable panel assembly having plural graphic areas arranged to be illuminated upon the application of electrical energy thereto, whereupon the second illuminatable panel assembly can provide a different animated display, said housing a releasably securable frame for protecting said peripheral edge of said first illuminatable panel assembly or the second illuminatable panel assembly when either illuminatable panel assembly is mounted within said portion of said housing.

* * * * *